United States Patent [19]

Koppers et al.

[11] 4,147,459

[45] Apr. 3, 1979

[54] SHIFTING DEVICE CONNECTED WITH A LONGWALL CONVEYOR FOR A PROGRESSIVE TIMBERING FRAME

[75] Inventors: Manfred Koppers, Duisburg-Hamborn; Harry Oppenländer, Wetter, both of Fed. Rep. of Germany

[73] Assignee: Thyssen Industrie AG, Fed. Rep. of Germany

[21] Appl. No.: 868,752

[22] Filed: Jan. 12, 1978

[30] Foreign Application Priority Data

Feb. 8, 1977 [DE] Fed. Rep. of Germany ..... 2705140

[51] Int. Cl.[2] ..... E21D 23/00

[52] U.S. Cl. ..... 405/303; 405/291

[58] Field of Search ..... 61/45 D, 63; 299/33; 198/300, 309

[56] References Cited

U.S. PATENT DOCUMENTS 3,952,525 4/1976 Walker et al. ..... 61/45 D

FOREIGN PATENT DOCUMENTS 652288 12/1964 Belgium ..... 61/45 D 999943 7/1965 United Kingdom ..... 61/45 D

*Primary Examiner*—Mervin Stein

*Assistant Examiner*—David H. Corbin

*Attorney, Agent, or Firm*—McGlew and Tuttle

[57] ABSTRACT

A timbering device connected to a longwall conveyor disposed toward the mining face of an excavation for progressively timbering frames from the gobbing side toward the mining face side comprises first and second skids which are adapted to be shifted over the floor. The guide piece is pivoted to one of the skids adjacent the gobbing side thereof and it has a guide slot extending toward the mining face. A push rod has one end connected to the longwall conveyor and an opposite end having a slide portion which is slidable in the guide piece guide slot. A thrust drive piston has a gobbing side end pivotally connected to the slide piece portion of the push rods and has an opposite mounting face end which is pivotally connected to a bracket carried under one of said skids. The sliding plane control device is carried by the pusher rod.

3 Claims, 5 Drawing Figures

GOBBING SIDE
MINING FACE

SHIFTING DEVICE CONNECTED WITH A LONGWALL CONVEYOR FOR A PROGRESSIVE TIMBERING FRAME

BACKGROUND OF THE INVENTION

1. Field of the Invention

The invention relates in general to devices for mining operations and in particular to a new and useful shifting device connected with a longwall conveyor for a progressive timbering frame, which consists essentially of a push rod articulatedly connected on the mining side with the longwall conveyor and of a thrust piston drive, the push rod carrying on the mining side a sliding plane control device.

2. Description of the Prior Art

Shifting devices for underground operations operate as the longwall conveyor is being shifted so that the thrust piston drive braces itself against the timbering frame clamped between the hanging wall and the foot wall and moves a conveyor against the mining face by the push rod. In addition, as the timbering frame is being shifted, the thrust piston drive pulls the timbering frame toward the longwall conveyor by the push rod. In such shifting devices, jamming of the push rod will occur again and again due to the fact that the push rod is subjected, due to the plane control device articulated to it on the mining side, to bending stresses which strive to lift or push down the gobbing side and of the push rod, depending on the direction in which the plane is articulated. These movements and stresses are caused in particular by the fact that the plane and the longwall conveyor "breathe" because of the naturally different density of the seam upon passage of the plane.

From German Application No. 25 22 117 such a shifting device has become known, in which the abovementioned difficulties were expected to be eliminated by the fact that the gobbing side end sections of the skids of the timbering frame and of the push rod, or so-called "guide carriage", are provided in the zone of the opposite lateral faces with interengaging projections and recesses which limit the vertical mobility of the push rod. As projections there are provided here lateral pins extending essentially at right angles away from the push rod, which engage in longitudinal grooves at the opposite skid side-faces and are displaceable therein.

It was found that this design of a shifting device is not satisfactory because with it, too, jamming occurs between the guide elements on the push rod and on the skids and also at the gobbing side end of the timbering frame, caused by the fact that often only one of the two skids is lifted at the gobbing side end, either during advance of the timbering frame or because of unevennesses of the sill, so that the push rod projections engaging into the guide grooves and the push rod itself are twisted. This is especially true in the case of timbering frames with lemniscate linkages, where, upon lifting, the skids execute a vertical as well as a horizontal movement. As a result, in many cases shifting of the frame and/or the conveyor is extremely difficult and time-consuming.

SUMMARY OF THE INVENTION

The present invention provides an improved shifting device in which oblique positions of the guide elements between the push rod and the skids as well as jamming and immobility of the push rod caused thereby are avoided absolutely reliably.

The invention is an improvement over the German disclosure No. 25 22 117 wherein according to the invention in a shifting device for progressive timbering frames which is connected with a longwall conveyor and which includes a push rod which is articulatedly connected with the longwall conveyor on the mining side and carries a sliding plane control device which is arranged between the skids of the timbering frame, and is displaceably mounted at the skid end at its gobbing side end. It also includes a thrust piston drive which on the gobbing side is articulatedly connected with the push rod and is articulatedly supported at the skids of the timbering frame on the mining side. The characterizing features are that, at the gobbing side end of the timbering frame, a box type guide-piece arranged between the skids thereof and extending in the direction of the mining face is fastened by a hinge pin with only one skid, and at the gobbing side end the push rod comprises a slide-piece with a bracket type shoulder guided in the guide piece. The shoulder at the gobbing side end of the thrust piston drive is connected by means of a pin joint.

The shifting device according to the invention has the advantage that, by the unilateral suspension of the guide piece by means of a hinge pin in one of the two skids of the timbering frame, all jamming and twisting in the push rod guide is reliably avoided. This is also true if, even for any reason, one of the two skids is raised; or is lower than the other. The box type guide piece can move freely between the two skids about the hinge pin by which it is fastened to one skid. Consequently, also movements of the slide piece mounted at the bobbing side end of the push rod in the guide piece, and hence longitudinal movements of the push rod itself, are not hindered.

Movements of the plane control device supported at the mining side end of the push rod remain without adverse effects on the mobility of the push rod in its guide at the gobbing side end and the push rod remains freely movable in its guide in longitudinal directions so that also the "breathing" of the longwall conveyor and of the sliding plane is not hindered.

Accordingly it is an object of the invention to provide a timbering device connected to a longwall conveyor and disposed toward the mining face of an excavation for progressively timbering frames from the gobbing side toward the mining face and which comprises first and second skids adapted to be shifted over the floor with a guide piece being pivotally connected to one of the skids adjacent the gobbing side and having a guide slot extending toward the mining face with a push rod slide guided in the slot and having an opposite push rod end connected to the longwall conveyor and including a thrust drive piston which has one end pivotally connected to the slide piece portion of the push rod and an opposite end which is connected to a bracket which is carried on one of the skids and wherein the push rod carries a sliding plane control device.

A further object of the invention is to provide a shifting device connected with a longwall conveyor for a progressive timbering frame which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention are illustrated.

GENERAL DESCRIPTION OF THE PREFERRED EMBODIMENTS

Figure 1:
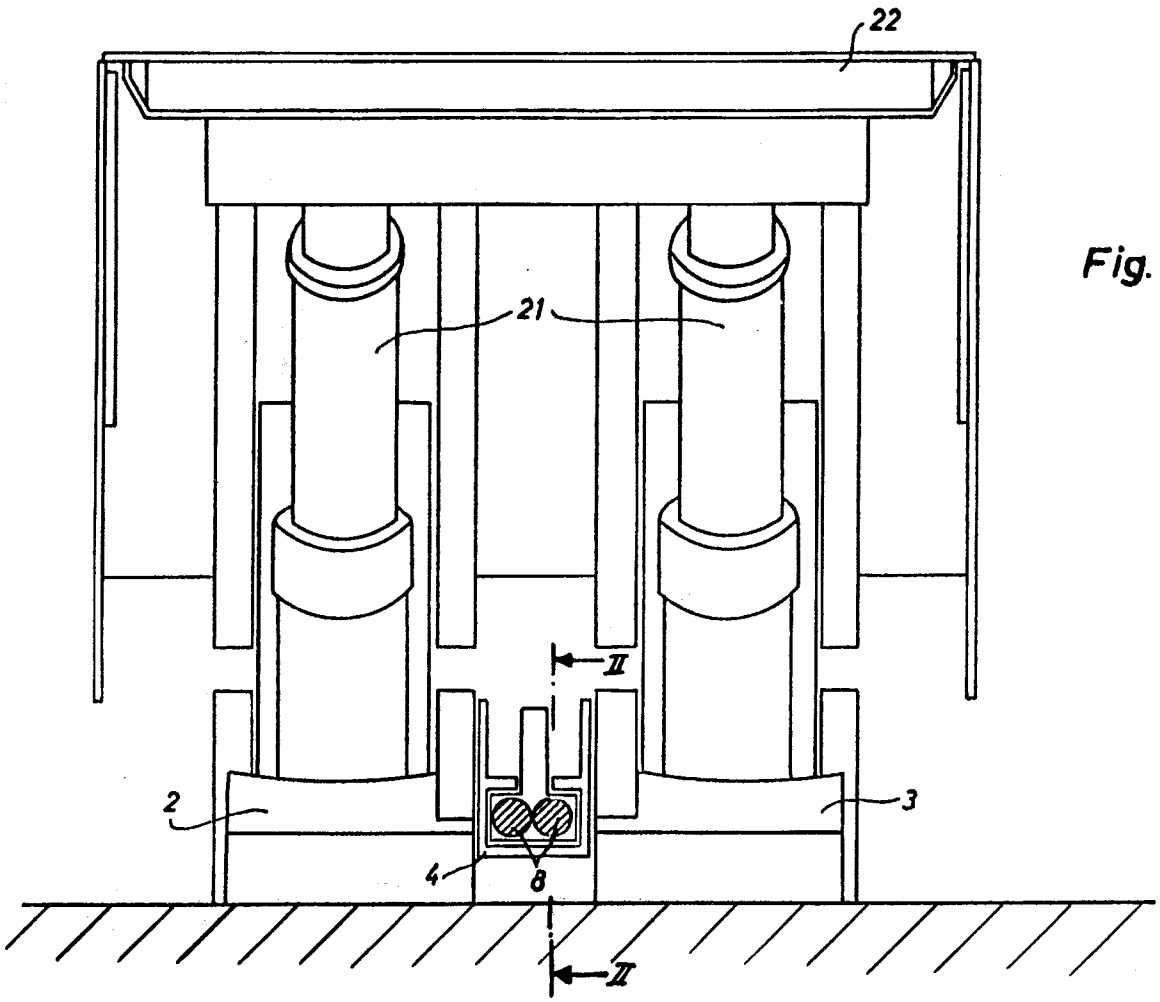
FIG. 1 is a partial elevational and partial sectional view taken along the lines I—I of FIG. 2 and constructed in accordance with the invention.
Figures 2, 3, 4:
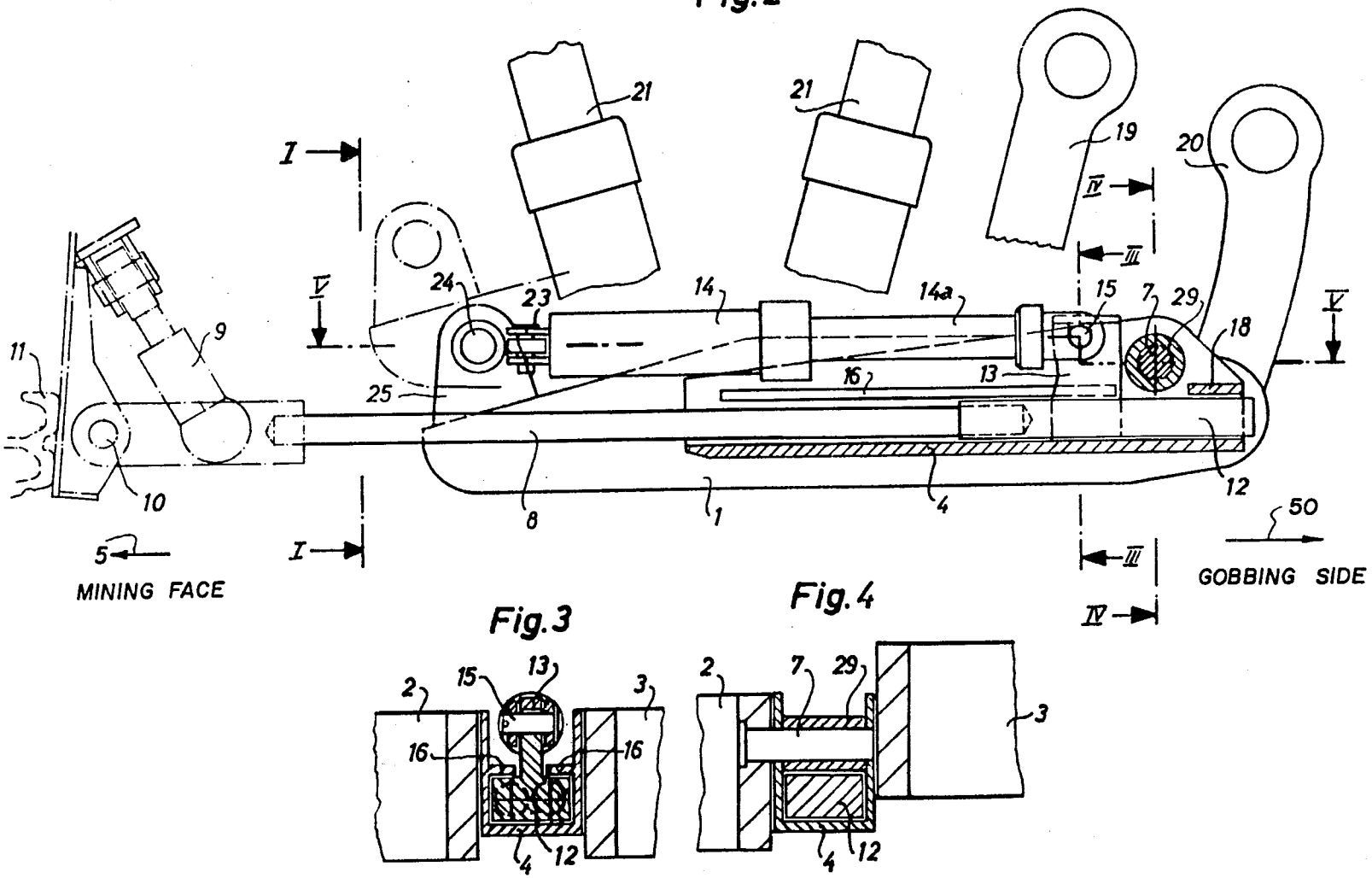
FIG. 2 is a section taken on the lines II—II of FIG. 1.
FIG. 3 is a section taken along the lines III—III of FIG. 2.
FIG. 4 is a section taken along the lines IV—IV of FIG. 2.

Referring to the drawings in particular the invention embodied therein comprises a timbering device connected to a longwall conveyor 11 for progressively timbering frames in respect to a mining face in the direction indicated by the arrow 5 from a gobbing side indicated by the arrow 50 in FIG. 2.

Figure 5:
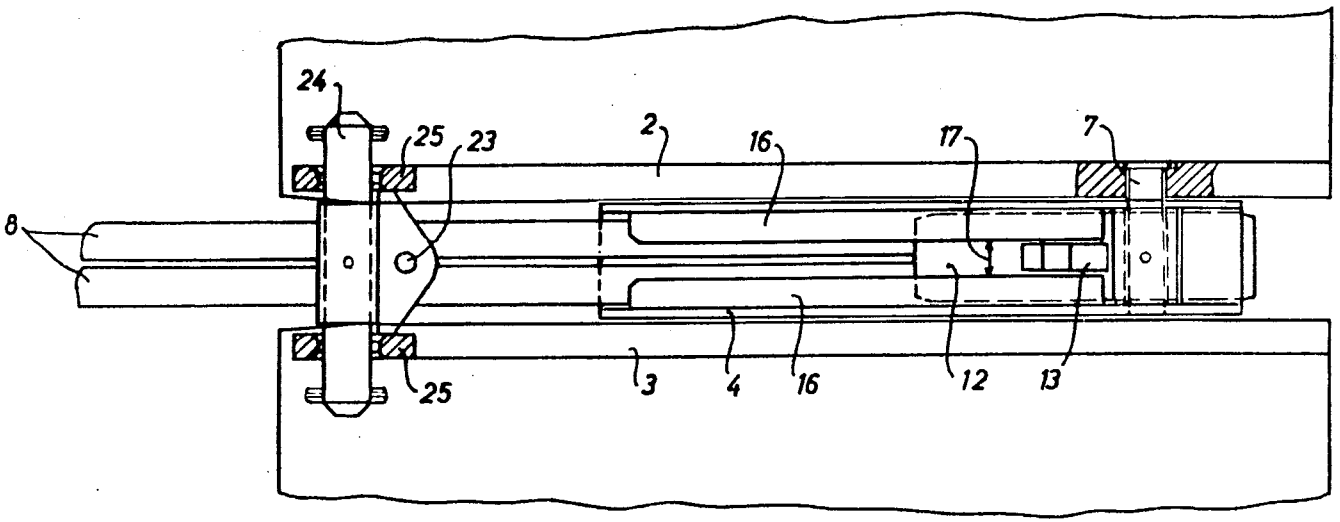
FIG. 5 is the section taken along the lines V—V of FIG. 2 but without the thrust piston drive.

At the gobbing side end of a timbering frame 1, which comprises a pair of skids 2 and 3, a plurality of posts 21, a shield roof 22, a push rod 8 designed as a double rod, and a thrust piston drive 14, a box-type guide piece 4 is disposed between the skids 2 and 3 and extends in the direction of the mining face indicated by arrow 5. The guide piece 4 is secured by means of hinge pins 7 to only one skid, namely skid 2, so that at vertical movements of the skid 2 it can pivot about the hinge pin 7. Vertical movements of the skid 3 have no effect on the position of the guide piece 4. On the mining side the push rod 8 carries a sliding plane control device 9 and is connected through a pivot 10*a* of a bracket 10 with the longwall conveyor 11 in a manner known in itself. The push rod 8 is designed as a double rod, also in known manner, and comprises at its end at the gobbing side shown by arrow 50 a slide piece 12 with a bracket type shoulder 13. At this shoulder 13, the gobbing side end of the thrust piston drive 14, namely the free end of the piston rod 14*a*, is connected by means of a pin joint 15. The box type guide piece 4 is approximately U-shaped and has a longitudinal slot 17 (FIG. 5) in which the bracket type shoulder 13 of the slide piece 12 can freely move. Needless to say, the underside of the guide piece 4 is kept at a certain distance from the foot wall to assure a certain freedom with respect to the floor. A bearing bushing 29 for the hinge pin 7 and a cross prop 18 are disposed at the gobbing side end of the guide piece 4 on the top side thereof to stiffen the guide piece 4 in lateral direction. The thrust piston drive 14 is articulatedly supported in a manner known in itself through crosswise disposed hinge pins 23 and 24 and brackets 25 at the mining side ends of the skids 2 and 3, being braced against them. By 19 and 20 are denoted lemniscate links known in themselves which for reasons of greater clarity are illustrated only schematically.

While specific embodiments of the invention have been shown and described in detail to illustrate the application of the principles of the invention, it will be understood that the invention may be embodied otherwise without departing from such principles.

What is claimed is:

1. A timbering device connected to a longwall conveyor disposed toward the mining face of an excavation for progressively timbering frames from the gobbing side toward the mining face, comprising first and second skids adapted to be shifted over the floor, a guide piece, pivot means pivotally connecting said guide piece to only one of said skids adjacent the gobbing side, said guide piece having a guide slot extending toward the mining face, a push rod having one end connected to the longwall conveyor and an opposite end having a slide piece portion slidable in said guide piece guide slot, a thrust drive piston having a gobbing side end pivotally connected to said slide piece portion of said push rod and having an opposite mining face end partially connected to the mining side end of both said first and second skids, and bracket means pivotally connected to said thrust drive piston and to said one of said skids, and a sliding plane control device carried by said pusher rod.

2. A timbering device according to claim 1, wherein said guide piece comprises a box like member disposed between said skids and elongated in a longitudinal direction between said mining face and said gobbing side, including a hinge pin pivotally connecting said guide piece to said one skid, said push rod having a bracket-like shoulder forming said slide piece portion guided in said guide piece.

3. A shifting device according to claim 1, wherein said guide piece comprises a rectangular hollow member having a top wall with a slide extending longitudinally therealong, said slide piece portion including a rectangular portion within said guide piece and having an upstanding central portion forming a bracket shoulder extending through said slot and pivotally connected to said thrust system at the gobbing side end thereof.

* * * * *